US006457688B1

(12) United States Patent
Welfonder

(10) Patent No.: US 6,457,688 B1
(45) Date of Patent: Oct. 1, 2002

(54) END CAP AND MOUNTING SUPPORT COMBINATION

(75) Inventor: Konrad Welfonder, Bremerhaven (DE)

(73) Assignee: Hunter Douglas Industries B.V., EL Rotterdam (NL)

( * ) Notice: Subject to any disclaimer, the term of this patent is extended or adjusted under 35 U.S.C. 154(b) by 0 days.

(21) Appl. No.: 09/453,849

(22) Filed: Dec. 2, 1999

(30) Foreign Application Priority Data

Dec. 3, 1998 (EP) ..... 98204081

(51) Int. Cl.[7] ..... A47H 1/10; A47G 5/02

(52) U.S. Cl. ..... 248/266; 248/268; 248/252; 160/323.1

(58) Field of Search ..... 248/252, 261, 248/266, 268; 160/323.1, 324, 325, 326, 319, 321

(56) References Cited

U.S. PATENT DOCUMENTS

| | | | | | |
|---|---|---|---|---|---|
| 778,649 | A | * | 12/1904 | Flores | 24/645 |
| 1,233,007 | A | * | 7/1917 | Willeford | 248/266 |
| 2,030,960 | A | * | 2/1936 | Burns | 160/176.1 |
| 2,155,944 | A | * | 4/1939 | Lewis | 160/174 |
| 2,275,907 | A | * | 3/1942 | Kahn | 248/267 |
| 2,420,977 | A | * | 5/1947 | Pye | 248/258 |
| 2,448,481 | A | * | 8/1948 | Wise | 160/324 |
| 4,249,714 | A | | 2/1981 | Boyle | |
| 4,729,418 | A | | 3/1988 | Rude | |
| 4,751,953 | A | * | 6/1988 | Appel et al. | 160/313 |
| 5,031,682 | A | * | 7/1991 | Tedeschi | 160/315 |
| 5,205,332 | A | * | 4/1993 | Lii | 160/23.1 |
| 5,450,891 | A | | 9/1995 | Benthin | |
| 5,860,198 | A | * | 1/1999 | Bauntin, Jr. | 24/600.5 |
| 5,881,792 | A | * | 3/1999 | Cheng | 160/263 |
| 6,237,669 | B1 | * | 5/2001 | Ko | 160/177 V |
| 6,289,964 | B1 | * | 9/2001 | Colson et al. | 160/121.1 |

FOREIGN PATENT DOCUMENTS

| | | |
|---|---|---|
| EP | 0465433 | 1/1992 |
| GB | 434043 | 8/1935 |
| NL | 8400103 | 8/1985 |

* cited by examiner

*Primary Examiner*—Anita King
*Assistant Examiner*—Naschica S Morrison
(74) *Attorney, Agent, or Firm*—Dorsey & Whitney LLP

(57) ABSTRACT

An end cap and mounting support combination comprising an end cap (11, 111, 211, 311, 411) disengagably engagable with a support bracket (3) and one of the end cap and the support bracket being provided with: a laterally open slot (20, 120, 220, 320, 420) for accommodating an axially extending protuberance (21) on the other of the end cap and the support bracket; and closing means to prevent the protuberance from escaping from the laterally open slot; wherein the closing means comprises a rotatable locking collar (19, 119, 219, 319, 419) surrounding the laterally open slot and having a circumferential entrance opening (23, 123, 223, 323, 423) which can be aligned with the laterally open slot by rotation of the locking collar relative to the laterally open slot from a closed position to an open position, thereby selectively providing access to the laterally open slot through the circumferential entrance opening.

14 Claims, 7 Drawing Sheets

END CAP AND MOUNTING SUPPORT COMBINATION

CROSS-REFERENCE TO RELATED APPLICATION

This application corresponds to and claims priority to European Application No. 98204081.8, filed Dec. 3, 1998. This European application is hereby incorporated by reference as though fully set forth herein.

BACKGROUND OF THE INVENTION a. Field of the Invention

This invention relates to a combination of an end cap and a mounting support for a roller, especially a roller of an architectural covering and particularly a winding roller for a covering for an architectural opening, such as a window blind or shade.

b. Background Art

Combinations of end caps and mounting supports for rollers are known from British patent specification GB 434 043 and Dutch published patent application NL 84 00103. In each of the combinations of an end cap and a mounting support of these publications, the end cap can be engaged and disengaged from the mounting support. Either the end cap or the mounting support has an axially open slot or recess for accommodating an axially projecting pin or protuberance on the other and there are means adjacent to the axial recess to engage and hold the axial pin within the axial recess and to release the axial pin from such engagement. From these publications, it has also been clear that there could suitably be a kinematic inversion of their axial recesses and axial pins on their end caps and mounting supports that would simply lead to different positions for these elements.

However, access to the means for engaging and releasing the axial pin from the axial recess on such end caps and mounting supports has generally been only from one direction. As a result, access to the means for engaging and releasing the axial pin, which could well be resilient, to activate or deactivate it has been somewhat limited. In this regard, winding rollers for window shades and blinds have typically been mounted in confined spaces near the top of window frames. Also the axial recesses of winding rollers have often been placed in hard-to-reach vertical or horizontal positions, depending on whether the mounting supports have been affixed to a wall or to a ceiling adjacent to the window. This has frequently made it difficult to engage or disengage the axial pin from the axial opening when installing or removing a winding roller of a shade or blind from a window frame.

SUMMARY OF THE INVENTION

In order to overcome or ameliorate at least some of the disadvantages of known combinations of end caps and mounting supports, the combination of an end cap and mounting support of this invention comprises: an end cap disengagably engagable with a support bracket and one of the end cap and the support bracket being provided with: a laterally open slot for accommodating an axially extending protuberance on the other of the end cap and the support bracket; and closing means to prevent the protuberance from escaping from the laterally open slot; wherein the closing means comprises a rotatable locking collar surrounding the laterally open slot and having a circumferential entrance opening which can be aligned with the laterally open slot by rotation of the locking collar relative to the laterally open slot from a closed position to an open position, thereby selectively providing access to the laterally open slot through the circumferential entrance opening.

Advantageously, the end cap and mounting support combination also comprises means for retaining the locking collar in the closed position. Preferably, the retaining means comprise a resilient spring means for biasing the locking collar into its closed position.

Advantageously, the end cap and mounting support combination further comprises a manually engagable projection on diametrically opposite sides of the locking collar.

BRIEF DESCRIPTION OF THE DRAWINGS

Further aspects of the invention will be apparent from the detailed description below of particular embodiments and the drawings thereof, in which.

In these Figures, corresponding parts in different embodiments are referred to by corresponding names and by the same last two reference numerals.

DETAILED DESCRIPTION OF THE INVENTION

Figure 1:
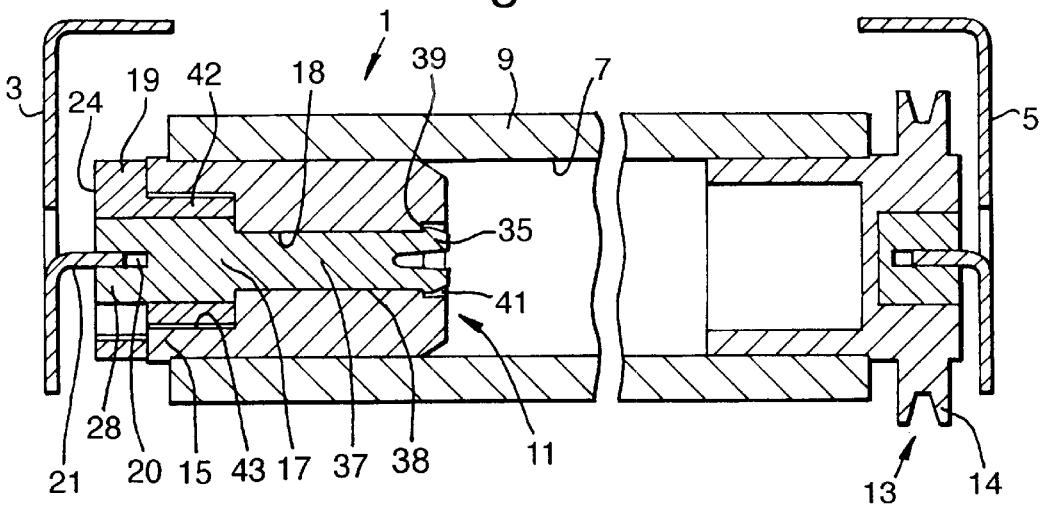
FIG. 1 is a longitudinal or axial cross-section through a winding roller of a shade or blind; the roller is journalled between a pair of mounting brackets and has, on one of its longitudinal ends, a first embodiment of an idle end cap of this invention.

FIG. 1 shows, in longitudinal or axial cross-section, a roller shade, generally 1. The ends of the roller shade 1 are attached to a pair of conventional left and right, support brackets 3, 5 for mounting the roller shade on a wall, adjacent to a window (not shown). For convenience, the left and right brackets 3, 5 can be identical to limit the number of items that need to be stocked by those who sell or install the roller shade 1. The roller shade 1 has an axially extending, elongate hollow tubular winding roller 7, about which are a plurality of windings of a flexible shade 9. The top end of the shade 9 is attached to the roller 7 in a conventional manner.

Within the left end portion of the roller 7, as shown in FIG. 1, is a generally tubular, idle end cap 11 of this invention. As described below, the idle end cap 11 can be mounted on, and rotatably journalled relative to, the left bracket 3 in a conventional manner. A conventional driving end cap 13 for rotating the roller 7, when winding or unwinding the flexible shade or blind 9, is mounted on the right bracket 5 as shown in FIG. 1. The driving end cap 13 has a grooved pulley 14 for engagement with a driving cord (not shown).

Figure 2:
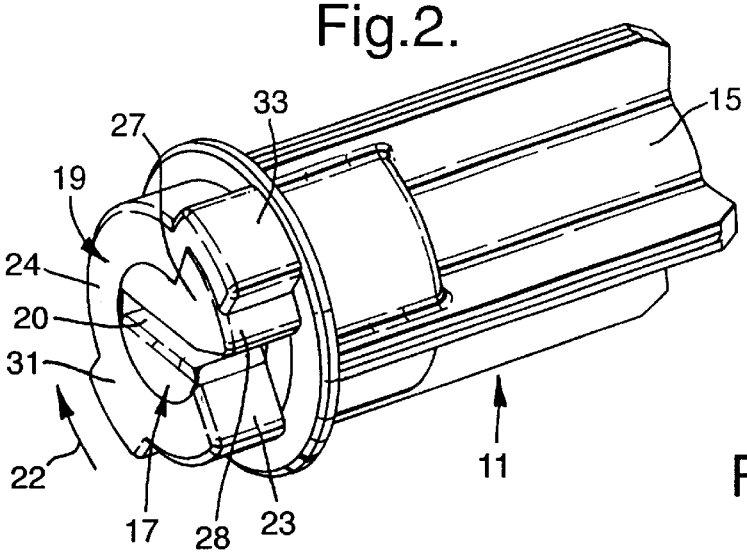
FIG. 2 is a perspective view showing the idle end cap of FIG. 1 in an open position.
Figure 3:
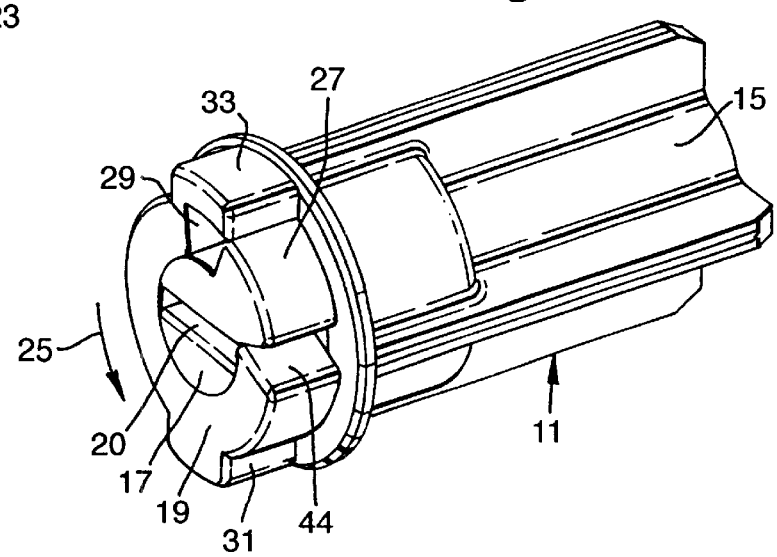
FIG. 3 is a perspective view, similar to FIG. 2, showing the idle end cap of FIG. 1 in a closed position.

As seen from FIGS. 1–3, the idle end cap 11 includes: a generally tubular, axially extending, outer body 15, to be inserted in the left end of the roller 7; a generally cylindrical, axially extending, central pin 17, concentrically received within a generally tubular, axially extending, central bore 18 of the outer body 15; and a generally tubular, axially extending, rotatable locking collar 19 concentrically located between the central pin 17 and the outer body 15. The left end of the central pin 17 is provided with a laterally or axially open, radially extending, central slot or recess 20, by which it can engage a laterally elongate, relatively flat tab or protuberance 21 extending axially to the right on the left bracket 3 as shown in FIG. 1 and described below. The outer body 15, which is non-rotatably received in the roller 7, is free to rotate with the roller 7 around the central pin 17, which is held stationary by the tab 21 on the left bracket 3.

The locking collar 19, as shown in FIGS. 2 and 3, is only capable of limited rotation about the central pin 17 of the idle end cap 11. FIG. 2 shows a first rotational end position of the locking collar 19 after rotation in the clockwise direction of arrow 22. In this first end position of FIG. 2, the central slot 20 is in communication with a circumferential entrance opening or radial opening 23 in an enlarged, axially extending, left end portion 24 of the locking collar 19. As a result of its communication with the radial opening 23 in the locking collar 19, the central slot 20 is open, so that the flat tab 21 of the left bracket 3 (not shown in FIG. 2) can be radially inserted in the central slot 20. FIG. 3 shows a second rotational end position of the locking collar 19 after rotation in the counter-clockwise direction of arrow 25. In the second end position of FIG. 3, the central slot 20 is no longer in communication with the radial opening 23 in the left end portion 24 of the locking collar 19 and is therefore closed, so as to securely hold the flat tab 21 of the left bracket 3 (not shown in FIG. 3) within the locking collar.

As also seen from FIGS. 2 and 3, a radially projecting sector 27 is provided on the outer surface of the axially extending, left end portion 28 of the central pin 17. The projecting sector 27 limits rotational movement of the locking collar 19 relative to the central pin 17 to an arc within an annular recess 29 inside the axially extending, left end portion 24 of the locking collar 19. However, both the central pin 17 and the locking collar 19 can otherwise rotate 360° relative to the outer body 15.

To facilitate the rotation of the locking collar 19 about the central pin 17, the left end portion 24 of the locking collar 19 is also provided with at least two, radially extending ridges or projections 31, 33 which facilitate the grasping and rotation of the locking collar by hand. Preferably, the ridges 31, 33 are circumferentially spaced around the outer surface of the left end portion 24 of the locking collar 19 so that at least one of them can be grasped in whatever position the idle end cap 11 is mounted on the left bracket 3. In this regard, it is preferred that the ridges be on diametrically opposite sides of the locking collar 19.

As further seen from FIG. 1, the central pin 17 has a bifurcated, preferably mushroom-shaped, structure 35 on the right end of its relatively thinner, axially extending, right end portion 37. This right end portion 37 of the central pin 17 fits closely but rotatably within a right end portion 38 of the central bore 18 of the outer body 15, and the bifurcated, right end structure 35 of the central pin is adapted to snap-fit behind an annular edge 39 at the left end of a generally cylindrical, central cavity 41 at the right end of the outer body 15 and its central bore 18. Thereby, the bifurcated, right end structure 35 of the central pin 17 engages the annular edge 39 of the central cavity 41 of the outer body 15 to hold the central pin 17 securely within the outer body 15.

As still further seen from FIG. 1, the left end portion 28 of the central pin 17, which carries the central slot 20 at its left end, is thicker than the right end portion 37 of the central pin. As a result, the left end portion 28 of the central pin also fits closely but rotatably within the locking collar 19 but cannot move axially to the right into the thinner right end portion 38 of the central bore 18 of the outer body 15. A right end portion 42 of the locking collar 19 also fits rotatably: i) about the left end portion 28 of the central pin 17 and ii) within the left end portion 43 of the central bore 18 of the outer body 15, which is wider than the right end portion 38 of its central bore 18. It is preferred that means (not shown in FIGS. 1–3) be provided in the idle end cap 11 of FIGS. 1–3 for restraining free rotation of the locking collar 19 about the central pin 17 when the radial opening 23 in the locking collar has been positioned to close the central slot 20 in the central pin. Such restraining means can include: means for increasing the sliding friction between the central pin 17 and the locking collar 19; means providing an index between the central pin and the locking collar; or a resilient biasing means for urging the locking collar in the counter-clockwise direction of arrow 25 in FIG. 3. Several embodiments of the idle end cap of this invention, with different resilient biasing means acting between the central pin and the locking collar to restrain free rotation of the locking collar about the central pin, will be described below with reference to FIGS. 4–15.

As also seen from FIG. 3, a funnel-shaped recess 44 is formed between a portion of the locking collar 19 and the projecting sector 27 of the central pin 17 in the closed position of the locking collar 19. The recess 44 forms an entrance for a conventional flat pin of a support bracket (such as is seen in FIG. 1) into the central slot 20 of the central pin 17 when the central slot 20 is closed by the locking collar 19. By pressing the inclined side edges of the recess 44 against such a bracket pin, the locking collar 19 will be rotated clockwise to a sufficiently open position to allow the bracket pin to enter the central slot 20 via the radial opening 23 in the locking collar 19, notwithstanding any means that have been provided in the idle end cap 11 for restraining such rotation when the central slot 20 is closed.

Figure 4:
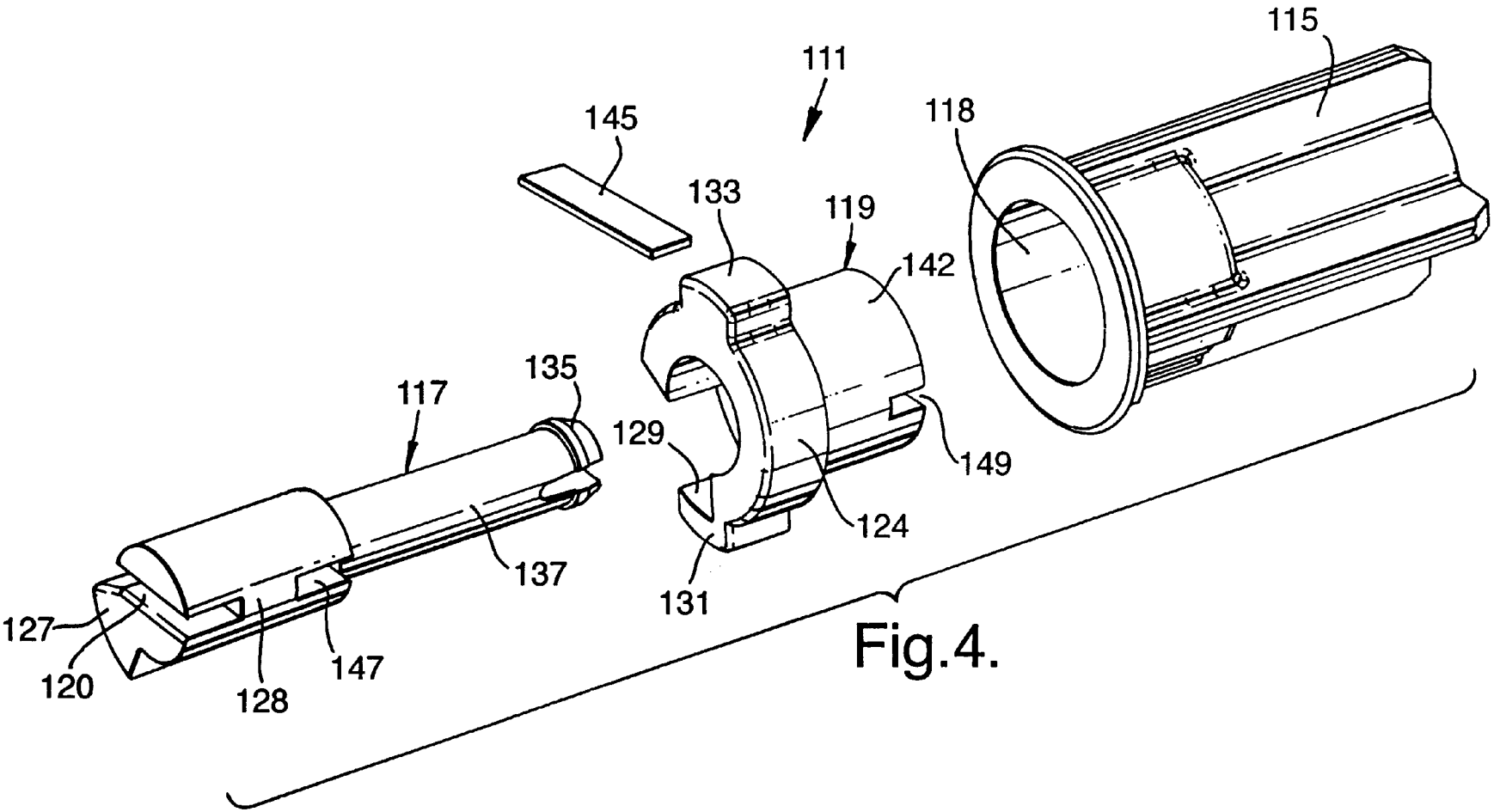
FIG. 4 is an exploded perspective view of a second embodiment of the idle end cap of this invention.
Figure 5:
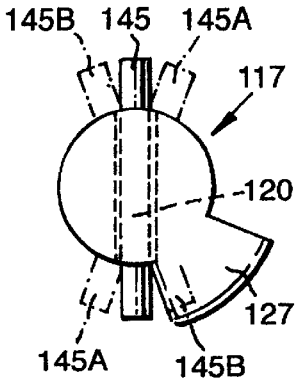
FIG. 5 is a schematic end view of a central pin and a leaf spring of the second embodiment of the idle end cap of FIG. 4.
Figure 6:
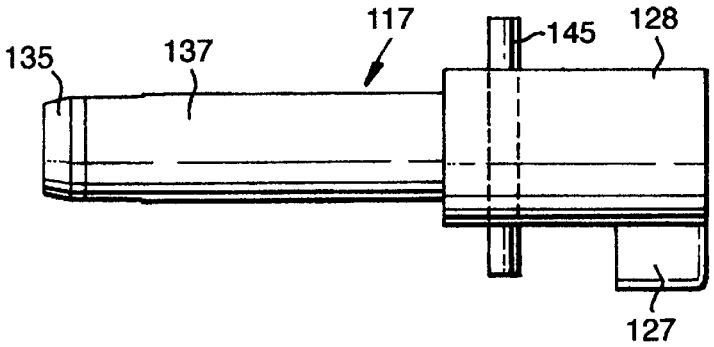
FIG. 6 is a schematic axial elevation view of the central pin and leaf spring of the second embodiment of the idle end cap of FIG. 4.

FIGS. 4–6 show a second embodiment 111 of the idle end cap of the invention, which is similar to the idle end cap 11 of FIGS. 1–3 and for which corresponding reference numerals (greater by 100) are used below for describing the corresponding parts.

The idle end cap 111, shown in FIGS. 4–6, has: an outer body 115, to be inserted in the left end of the roller 7 of FIG. 1; an axially extending, central pin 117, concentrically received within the outer body 115; and a rotatable locking collar 119 between the central pin 117 and the outer body.

A resilient biasing means for urging the locking collar 119 in the counter-clockwise direction is provided by a leaf spring 145. After the central pin 117 has been inserted into the locking collar 119, the leaf spring 145 can be inserted in a transverse slot 147 in the right end of the left end portion 128 of the central pin 117 and in a corresponding pair of radially aligned, transverse slots 149 that are in the right end of the right end portion 142 of the locking collar 119 and are radially aligned with the transverse slot 147 in the central pin. Preferably, the transverse slots 147 and 149 are each open at the respective right end of the left end portion 128 of the central pin 117 and the right end portion 142 of the locking collar 119. The resulting subassembly can then be inserted into the central cavity 118 of the outer body 115 and retained therein by the bifurcated right end structure 135 of the central pin 117.

FIGS. 5 and 6 schematically show the position of the leaf spring 145 with respect to the central pin 117. For clarity, the locking collar 119 and the outer body 115 have been deleted in FIGS. 5 and 6. In FIG. 5, which is an end on view of the central pin 117, the leaf spring 145 is shown (in solid lines) aligned in the transverse slot 147 in the central pin 117 with the central slot 120 in the central pin and is also shown (in dotted lines) in tangentially deflected positions 145A and 145B. Aligning the transverse slot 147 with the central slot 120 in the central pin 117 is not necessary, but it is preferred because it is easier to form both when making the central pin 117 by injection molding. The deflected positions 145A and/or 145B of the leaf spring 145 result when the locking collar 119 and its pair of transverse slots 149 are rotated relative to the central pin 117.

Figure 8:
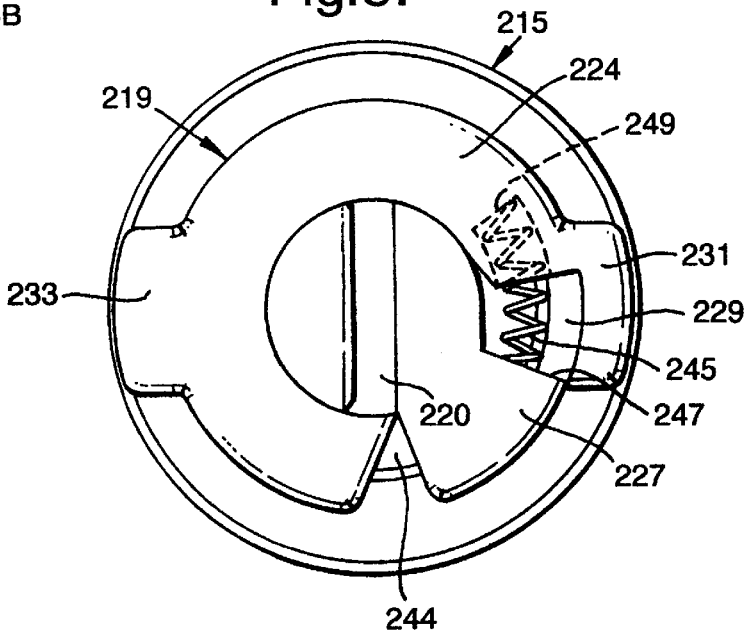
FIG. 8 is an end view of the third embodiment of the idle end cap of FIG. 7.
Figure 9:
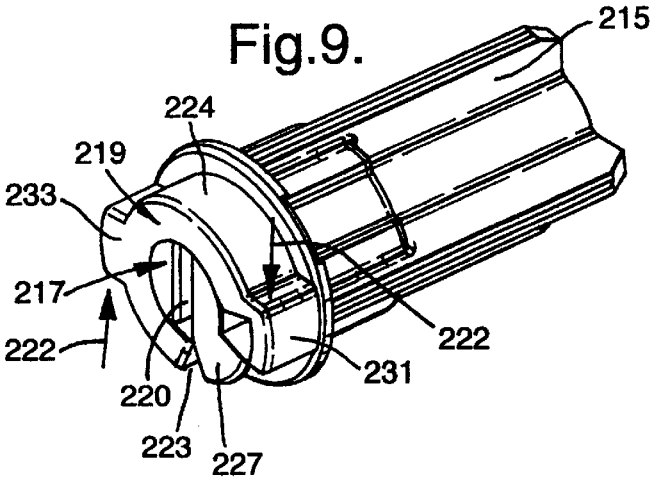
FIG. 9 is a perspective view of the third embodiment of the idle end cap of FIG. 7.
Figure 7:
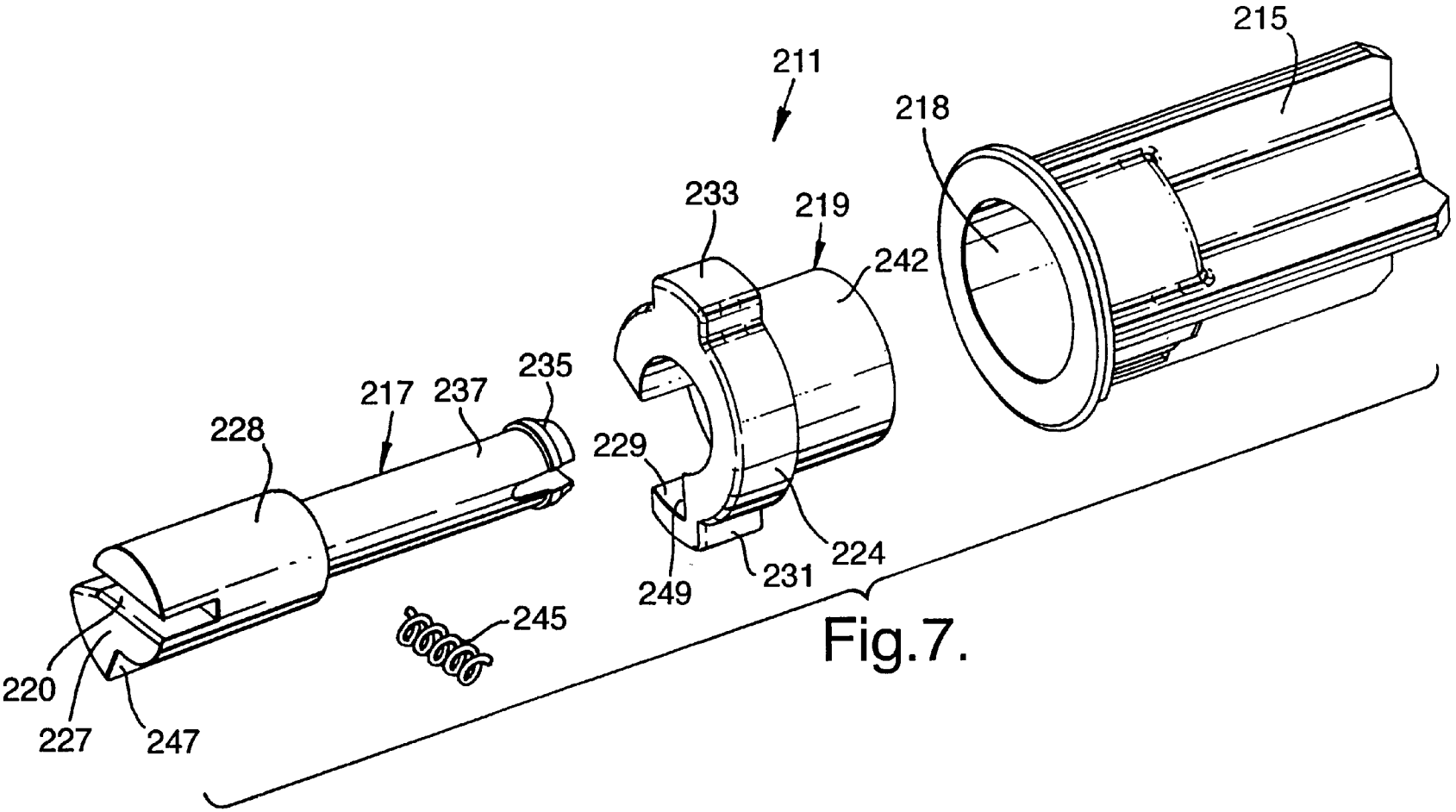
FIG. 7 is an exploded perspective view of a third embodiment of the idle end cap of this invention.

FIGS. 7–9 show a third embodiment 211 of the idle end cap of the invention, which is similar to the idle end cap 111 of FIGS. 4–6 and for which corresponding reference numerals (greater by 100) are used below for describing the corresponding parts.

The idle end cap 211, shown in FIGS. 7–9, has: an outer body 215, to be inserted in the left end of the roller 7 of FIG. 1; an axially extending, central pin 217, concentrically received within the outer body 215; and a rotatable locking collar 219 between the central pin 217 and the outer body. A coil spring 245 serves as a resilient biasing means for urging the locking collar 219 in the counter-clockwise direction. The coil spring 245, upon assembly of the central pin 217 and the locking collar 219, is engaged between a first radial surface 247 on the projecting sector 227 of the central pin 217 and a facing second radial surface 249 (shown in dotted lines in FIG. 8) in the annular recess 229 within the locking collar 219. Preferably, a cylindrical cavity is provided in one or both, particularly both, of the opposite radial surfaces 247, 249 to retain the coil spring 245 in position between them and to provide room for its compressed windings when the opposite radial surfaces 247, 249 abut one another in the open position of locking collar 219 and its radial opening 223, relative to the central slot 220 in the central pin 217.

FIG. 9 shows how either ridge 231, 233 on the left end portion 224 of the locking collar 219 can be urged to move in a clockwise direction 222 to rotate the locking collar and its radial opening 223 clockwise into an open position relative to the central slot 220 of the central pin 217. Such clockwise movement of the ridges 231, 233 and the locking collar 219 is against the force of the coil spring 245, urging the locking collar 219 to rotate in a counter-clockwise direction. Since the central pin 217 and locking collar 219, as a sub-assembly, are freely rotatable in the central bore 218 of the outer body 215, clockwise rotational movement of the ridges 231, 233 will only put the central slot 220 of the central pin in communication with the radial opening 223 in the locking collar when the flat tab 21 of the bracket 3, shown in FIG. 1, is engaged in the central slot 220 so as to keep the central pin 217 stationary. This is, in fact, the only situation in which one would need to open the locking collar 219 by hand.

Figure 10:
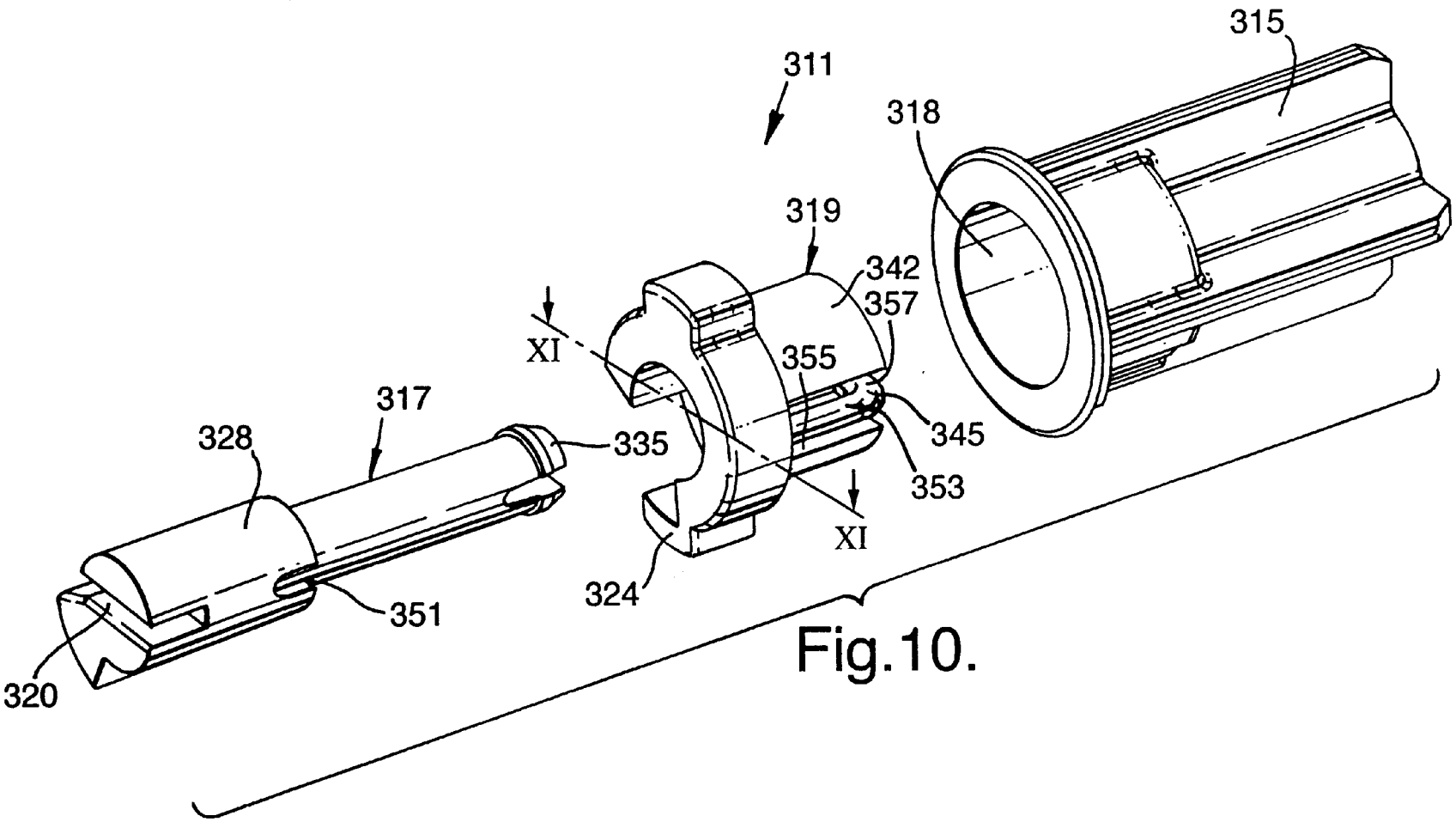
FIG. 10 is an exploded perspective view of a fourth embodiment of the idle end cap of this invention.
Figures 11, 12:
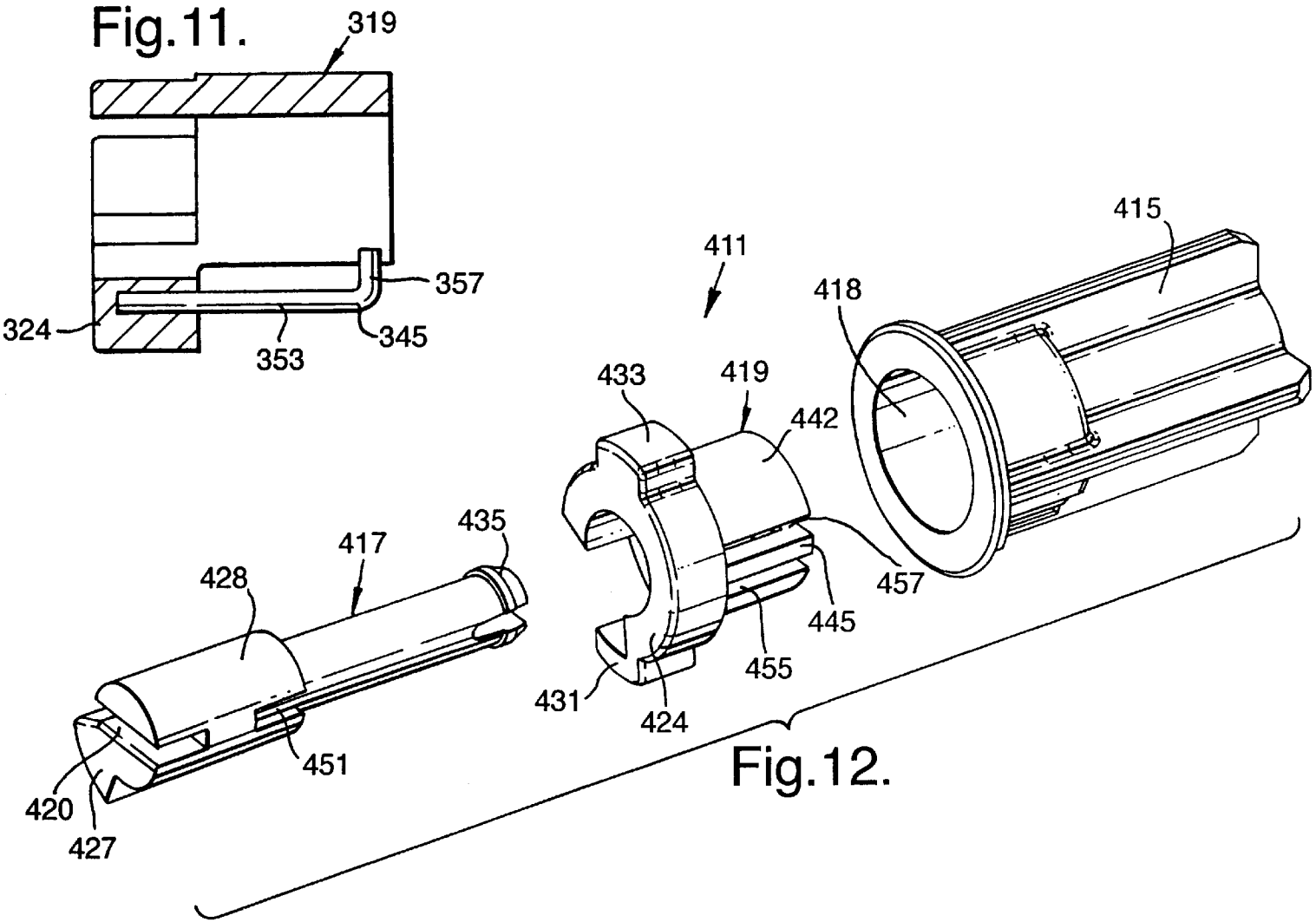
FIG. 11 is an axial cross-section of a locking collar of the fourth embodiment of the idle end cap of FIG. 10, viewed in the direction of the arrows XI—XI of FIG. 10.
FIG. 12 is an exploded perspective view of a fifth embodiment of the idle end cap of this invention.
Figure 13:
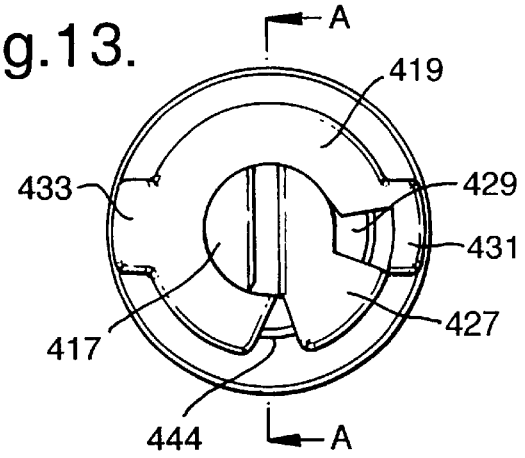
FIG. 13 is an end view of the fifth embodiment of the idle end cap of FIG. 12.

FIGS. 10 and 11 show a fourth embodiment 311 of the idle end cap of the invention, which is similar to the idle end cap 111 of FIGS. 4–6 and for which corresponding reference numerals (greater by 200) are used below for describing the corresponding parts.

The idle end cap 311, shown in FIGS. 10–11, has: an outer body 315, to be inserted in the left end of the roller 7 of FIG. 1; an axially extending, central pin 317, concentrically received within the outer body; and a rotatable locking collar 319 between the central pin and the outer body. The central pin 317 has a cavity 351 that is in the outer circumference of its left end portion 328 and that extends to, and is open at, the right end of the left end portion 328 of the central pin. The locking collar 319 has an L-shaped torsion spring 345. One leg 353 of the L-shaped torsion spring 345 is mounted in a recess 355 in the outer circumference of the right end portion 342 of the locking collar 319. The other leg 357 of the torsion spring 345 extends radially inwardly of the right end portion 342 of the locking collar 319 where this other leg 357 engages the cavity 351 of the central pin 317. In this regard, FIG. 11 shows, in detail, the mounting of the torsion spring 345 in the locking collar 319.

FIGS. 12–15 show a fifth embodiment 411 of the idle end cap of the invention, which is similar to the idle end cap 311 of FIGS. 10 and 11 and for which corresponding reference numerals (greater by 100) are used below for describing the corresponding parts.

Figure 14:
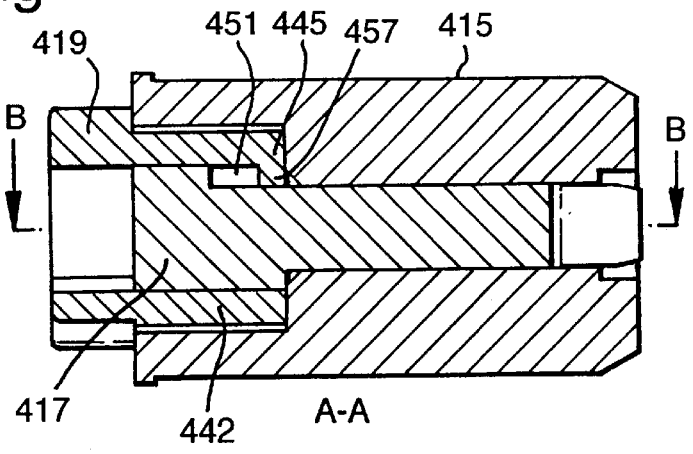
FIG. 14 is an axial cross-section of the fifth embodiment of the idle end cap of FIG. 12, viewed in the direction of the arrows A—A of FIG. 13.
Figure 15:
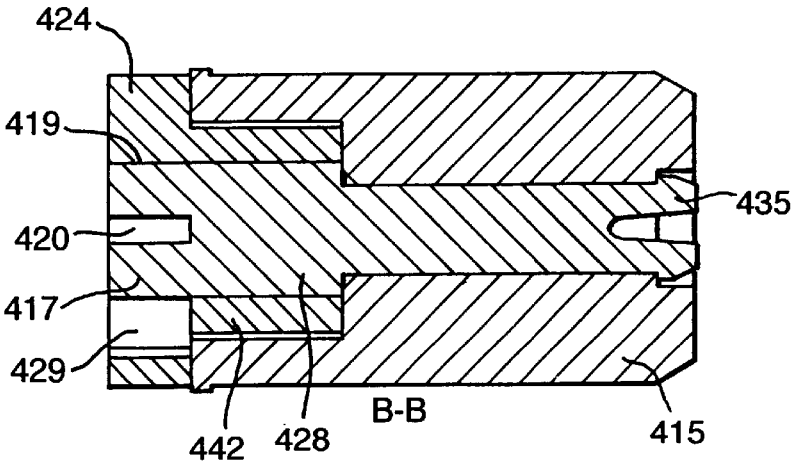
FIG. 15 is an axial cross-section of the fifth embodiment of the idle end cap of FIG. 12, viewed in the direction of the arrows B—B of FIG. 14.

The idle end cap 411, shown in FIGS. 12–15, has a central pin 417 with a cavity 451 that is in the outer circumference of its left end portion 428 and that extends to, and is open at, the right end of the left end portion 428 of the central pin. As best seen in FIG. 14, the locking collar 419 is provided with an integrally formed, L-shaped torsion spring 445. One leg 453 of the L-shaped torsion spring 445 is mounted in a recess 455 in the outer circumference of the right end portion 442 of the locking collar 419. The other leg 457 of the torsion spring 445 extends radially inwardly of the right end portion 442 of the locking collar 419 where this other leg 457 engages the cavity 451 of the central pin 417.

This invention is, of course, not limited to the above-described embodiments which may be modified without departing from the scope of the invention or sacrificing all of its advantages. In this regard, the terms in the foregoing description and the following claims, such as "left", "right", "longitudinal", "lateral", "bottom", "top", "axial", "radial", "clockwise", "counter-clockwise", "inner", "outer" and "end", have been used only as relative terms to describe the relationships of the various elements of the combination of an end cap and a mounting support for a roller of the invention. For example, the idle end caps 11, 111, 211, 311, 411 and support brackets 3,5 could also be used in combination with the winding roller of a roller blind for a window, as well as with a winding roller for the lifting cords of a folding blind or other collapsible window coverings. Likewise, the outer body 15, 155, 215, 315, 415 could be modified to achieve additional objectives in the operation of the roller 7.

While embodiments and applications of the present invention have been shown and described, it would be apparent to one skilled in the art that other modifications are possible without departing from the inventive concepts herein. The invention, therefore, is not to be restricted except in the spirit of the claims that follow.

I claim:

1. The combination of an end cap and a support bracket comprising:

a generally tubular end cap disengageably held on the support bracket; one of the end cap and the support bracket being provided with a laterally open slot for accommodating an axially-extending protuberance on the other of the end cap and support bracket and with closing means to prevent the protuberance from escaping from the slot; wherein the closing means comprises a rotatable locking collar surrounding the slot; the locking collar having a circumferential laterally open entrance opening which can be align with the slot by rotation of the locking collar about the slot to open the slot, thereby selectively providing the protuberance with access to the slot through the entrance opening, the end cap being concentrically and non-rotatably received in an open end of a roller; an end portion of the end cap extending outwardly of the open end of the roller and being provided with the slot for accommodating the protuberance on the support bracket; and the collar surrounding the end portion and being rotatable about the end portion to open the slot.

2. The combination of claim 1, wherein the locking collar is concentrically and rotatably received in a tubular and axially-extending bore of the end cap.

3. The combination of claim 1, wherein, the locking collar is generally tubular.

4. The combination of claim 2, wherein, the locking collar is generally tubular.

5. The combination of claim 4, wherein the end cap further comprises: a generally tubular axially-extending outer body which is fixedly attached in the open end of the roller; and a generally cylindrical axially-extending central pin, concentrically and rotatably mounted within a generally tubular, axially-extending, central bore of the outer body; and wherein the locking collar is concentrically located between the central pin and the outer body.

6. An architectural covering which includes a roller and a combination of an end cap and a support bracket, said combination comprising:

a generally tubular end cap disengageably held on the support bracket; one of the end cap and the support bracket being provided with a laterally open slot for accommodating an axially-extending protuberance on the other of the end cap and the support bracket and with closing means to prevent the protuberance from escaping from the slot; wherein the closing means comprises a rotatable locking collar surrounding the slot; the locking collar having a circumferential, laterally open, entrance opening which can be aligned with the slot by rotation of the locking collar about the slot to open the slot, thereby selectively providing the protuberance with access to the slot through the entrance opening, the end cap being concentrically and non-rotatably received in an open end of said roller; an end portion of the end cap extending outwardly of the open end of the roller and being provided with the slot for accommodating the protuberance on the support bracket; and the collar surrounding the end portion and being rotatable about the end portion to open the slot.

7. The covering of claim 6, wherein the locking collar is concentrically and rotatably received in a tubular and axially-extending bore of the end cap.

8. The covering of claim 6, wherein, the locking collar is generally tubular.

9. The covering of claim 7, wherein, the locking collar is generally tubular.

10. The covering of claim 9, wherein the end cap further comprises: a generally tubular axially-extending outer body which is fixedly attached in the open end of the roller; and a generally cylindrical axially-extending central pin, concentrically and rotatably mounted within a generally tubular, axially-extending, central bore of the outer body; and wherein the locking collar is concentrically located between the central pin and the outer body.

11. The combination of claim 3 further including retaining means for maintaining the locking collar in a position in which the entrance opening is misaligned with the slot.

12. The combination of claim 11 wherein the retaining means comprises a resilient spring means for biasing the locking collar into said position in which the entrance opening is misaligned with the slot.

13. The architectural covering of claim 8 further comprises retaining means for maintaining the locking collar in a position in which the entrance opening is misaligned with the slot.

14. The architectural covering of claim 13 wherein the retaining means comprises a resilient spring means for biasing the locking collar into said position in which the entrance opening is misaligned with the slot.

* * * * *